US008015730B2

(12) United States Patent
Hazenberg

(10) Patent No.: US 8,015,730 B2
(45) Date of Patent: Sep. 13, 2011

(54) FOOTWEAR WITH VERTICALLY-ARRANGED PUMP AND PRESSURE CHAMBERS

(75) Inventor: Klaas Pieter Hazenberg, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 863 days.

(21) Appl. No.: 11/620,792

(22) Filed: Jan. 8, 2007

(65) Prior Publication Data

US 2008/0163512 A1 Jul. 10, 2008

(51) Int. Cl.
*A43B 13/20* (2006.01)

(52) U.S. Cl. ..... 36/29; 36/35 B

(58) Field of Classification Search ..... 36/29, 35 B, 36/153, 154, 3 B
See application file for complete search history.

(56) References Cited

U.S. PATENT DOCUMENTS

| | | | | | |
|---|---|---|---|---|---|
| 1,145,533 | A * | 7/1915 | Wetmore | | 36/153 |
| 5,022,109 | A | 6/1991 | Pekar | | |
| 5,074,765 | A | 12/1991 | Pekar | | |
| 5,144,708 | A | 9/1992 | Pekar | | |
| 5,228,156 | A * | 7/1993 | Wang | | 5/677 |
| 5,372,487 | A | 12/1994 | Pekar | | |
| 5,406,661 | A * | 4/1995 | Pekar | | 36/29 |
| 5,437,615 | A | 8/1995 | Pekar et al. | | |
| 5,564,143 | A | 10/1996 | Pekar et al. | | |
| 5,638,565 | A | 6/1997 | Pekar | | |
| 5,647,078 | A | 7/1997 | Pekar | | |
| 5,794,361 | A * | 8/1998 | Sadler | | 36/29 |
| 5,865,166 | A | 2/1999 | Fitzpatrick et al. | | |
| 5,950,332 | A * | 9/1999 | Lain | | 36/3 B |
| 6,014,823 | A * | 1/2000 | Lakic | | 36/93 |
| 6,196,260 | B1 | 3/2001 | Pekar | | |
| 6,519,873 | B1 * | 2/2003 | Buttigieg | | 36/29 |
| 6,553,691 | B2 * | 4/2003 | Huang | | 36/29 |
| 6,598,250 | B1 | 7/2003 | Pekar | | |
| 2002/0194747 | A1 * | 12/2002 | Passke et al. | | 36/29 |
| 2006/0045780 | A1 | 3/2006 | Pekar | | |

FOREIGN PATENT DOCUMENTS

| | | |
|---|---|---|
| EP | 0972463 A | 1/2000 |
| WO | WO 01/70064 | 9/2001 |
| WO | 03075699 A1 | 9/2003 |

OTHER PUBLICATIONS

International Preliminary Report on Patentability and Written Opinion of the International Searching Authority in PCT Application No. PCT/US2008/050333, mailed Jul. 23, 2009.

* cited by examiner

*Primary Examiner* — Ted Kavanaugh
(74) *Attorney, Agent, or Firm* — Plumsea Law Group, LLC

(57) ABSTRACT

An article of footwear with an upper and a sole structure secured to the upper may include one or more fluid systems with a pump chamber and a pressure chamber located adjacent to and below the pump chamber. In one configuration, at least a portion of a fluid within the pump chamber is separated from a fluid within the pressure chamber by a single layer of a polymer material. The fluid system may also include a fluid path extending between the pump chamber and the pressure chamber, and substantially all of the fluid path may be located between the pump chamber and the pressure chamber. In another configuration, at least one-half of a volume of the pump chamber may be located above a highest point of the pressure chamber.

28 Claims, 17 Drawing Sheets

FOOTWEAR WITH VERTICALLY-ARRANGED PUMP AND PRESSURE CHAMBERS

BACKGROUND OF THE INVENTION

Conventional articles of athletic footwear include two primary elements, an upper and a sole structure. The upper is generally formed from a plurality of elements, such as textiles, foam, leather, and synthetic leather materials, that are stitched or adhesively bonded together to form an interior void for securely and comfortably receiving a foot. The sole structure incorporates multiple layers that are conventionally referred to as an insole, a midsole, and an outsole. The insole is a thin, compressible member located within the void of the upper and adjacent to a plantar (i.e., lower) surface of the foot to enhance comfort. The midsole is secured to the upper and forms a middle layer of the sole structure that attenuates ground reaction forces during walking, running, or other ambulatory activities. The outsole forms a ground-contacting element of the footwear and is usually fashioned from a durable and wear-resistant rubber material that includes texturing to impart traction.

The primary material forming many conventional midsoles is a polymer foam, such as polyurethane or ethylvinylacetate. In some articles of footwear, the midsole may also incorporate a sealed and fluid-filled chamber that increases durability of the footwear and enhances ground reaction force attenuation of the sole structure. In some footwear configurations, the fluid-filled chamber may be at least partially encapsulated within the polymer foam, as in U.S. Pat. No. 5,755,001 to Potter, et al., U.S. Pat. No. 6,837,951 to Rapaport, and U.S. Pat. No. 7,132,032 to Tawney, et al. In other footwear configurations, the fluid-filled chamber may substantially replace the polymer foam, as in U.S. Pat. No. 7,086,180 to Dojan, et al.

As an alternative to chambers, a footwear sole structure may also incorporate a fluid system that includes various components, such as a pressure chamber, a pump chamber for increasing a fluid pressure within the pressure chamber, one or more valves for regulating the direction and rate of fluid flow, and conduits that connect the various fluid system components. U.S. Pat. No. 6,457,262 to Swigart discloses a fluid system having a central chamber and two side chambers positioned on medial and lateral sides of the central chamber. Each of the side chambers are in fluid communication with the central chamber through at least one conduit that includes a valve. During walking or running, fluid within the fluid system may flow between the central chamber and the side chambers.

Fluid systems may also utilize ambient air (i.e., air drawn in from an exterior of the footwear or an exterior of the fluid system) as the system fluid. As an example, U.S. Pat. No. 6,889,451 to Passke, et al. discloses an article of footwear having a fluid system that utilizes ambient air to pressurize a pressure chamber. The fluid is drawn in through a filter, pressurized within a pump chamber in a forefoot area of the footwear, and transferred to a pressure chamber in a heel area of the footwear. When sufficiently pressurized, the pressure chamber serves to attenuate ground reaction forces. Another example of a fluid system utilizing ambient air is disclosed in U.S. Pat. No. 7,051,456 to Swigart, et al.

SUMMARY OF THE INVENTION

Various configurations of the invention involve an article of footwear with an upper and a sole structure secured to the upper. The sole structure includes a fluid system with a pump chamber and a pressure chamber located adjacent to and below the pump chamber. In some configurations, at least a portion of a fluid within the pump chamber is separated from a fluid within the pressure chamber by a single layer of a polymer material. In other configurations, the fluid system includes a fluid path extending between the pump chamber and the pressure chamber, and substantially all of the fluid path is located between the pump chamber and the pressure chamber. In yet other configurations, at least one-half of a volume of the pump chamber is located above a highest point of an upper surface of the pressure chamber. The footwear may also incorporate a plurality of separate fluid systems, each of the fluid systems having a pump chamber and a pressure chamber located adjacent to and below the pump chamber. Similar fluid systems may also be utilized in products other than footwear.

The advantages and features of novelty characterizing aspects of the invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention and the following Detailed Description of the Invention will be better understood when read in conjunction with the accompanying drawings.

DETAILED DESCRIPTION OF THE INVENTION

The following discussion and accompanying figures disclose various fluid system configurations. Concepts related to the fluid systems are disclosed with reference to an article of athletic footwear having a configuration suitable for the sport of running. The fluid systems are not solely limited to footwear designed for running, however, and may be incorporated into a wide range of athletic footwear styles, including basketball shoes, cross-training shoes, walking shoes, tennis shoes, soccer shoes, and hiking boots, for example. In addition, the fluid systems may be incorporated into footwear that is generally considered to be non-athletic, including dress shoes, loafers, sandals, and work boots. An individual skilled in the relevant art will appreciate, therefore, that the concepts disclosed herein relating to the fluid systems apply to a wide variety of footwear styles, in addition to the specific style discussed in the following material and depicted in the accompanying figures. In addition to footwear, concepts related to the fluid systems may be incorporated into a variety of other products, including various inflatable devices. Accordingly, aspects of the present invention have application in various technical areas, in addition to footwear.

First Fluid System

Figure 1:
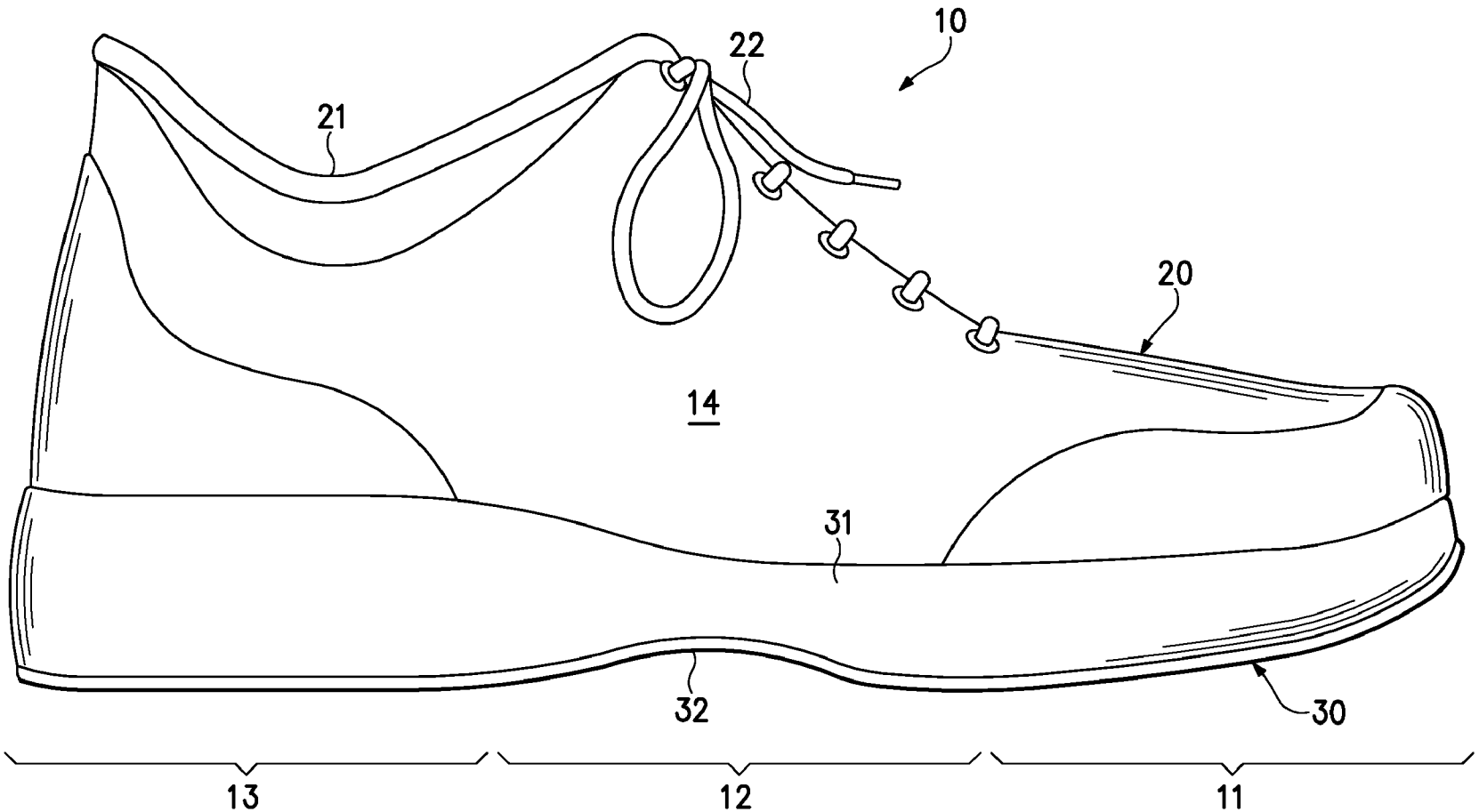
FIG. 1 is a lateral side elevational view of an article of footwear incorporating a first fluid system.
Figure 2:
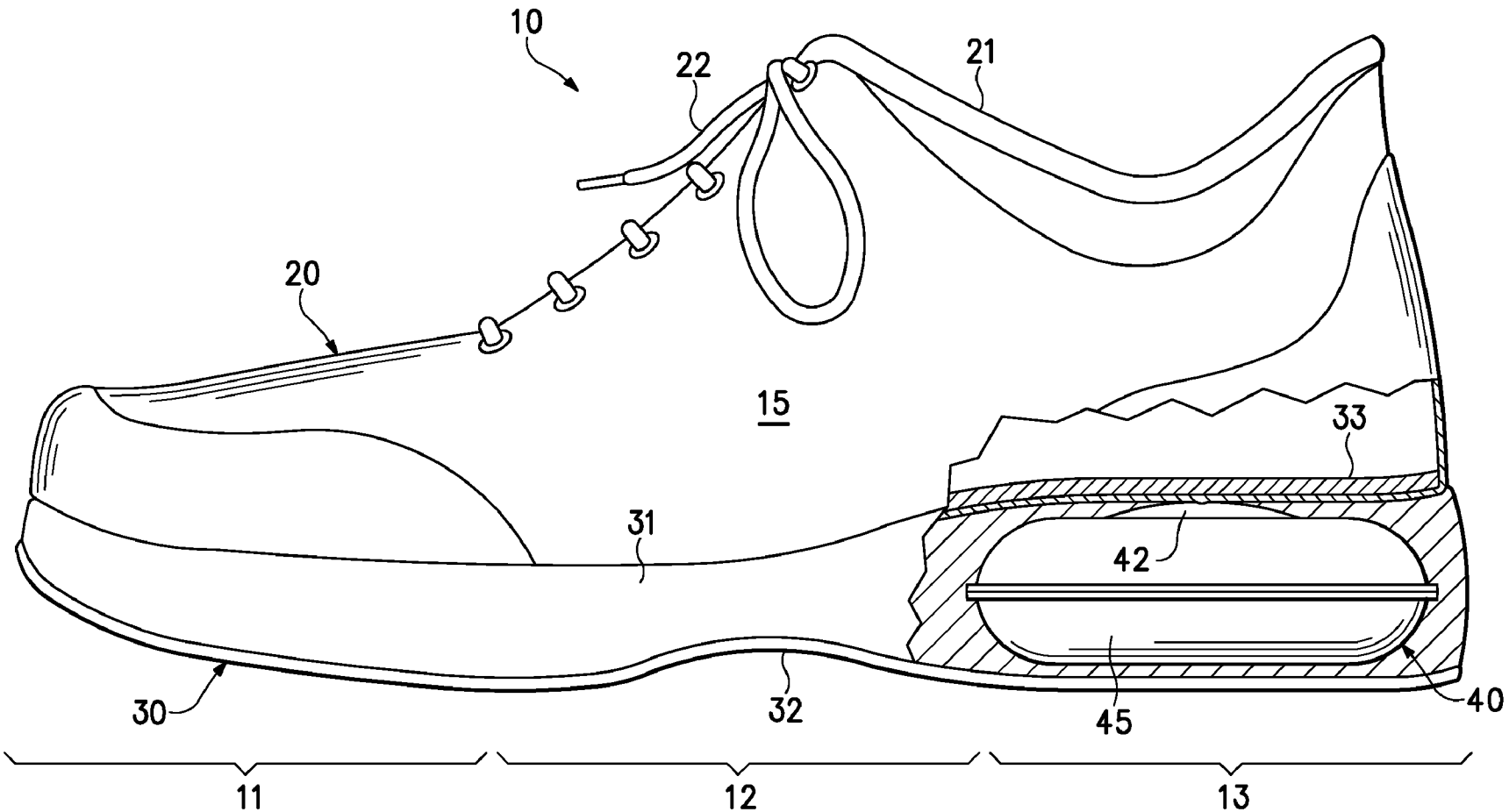
FIG. 2 is a medial side elevational view of the article of footwear, with a partial cut-away area to show portions of the first fluid system.

An article of footwear 10 is depicted in FIGS. 1 and 2 as including an upper 20 and a sole structure 30. For purposes of reference, footwear 10 may be divided into three general regions: a forefoot region 11, a midfoot region 12, and a heel region 13, as shown in FIGS. 1 and 2. Footwear 10 also includes a lateral side 14 and a medial side 15. Forefoot region 11 generally includes portions of footwear 10 corresponding with the toes and the joints connecting the metatarsals with the phalanges. Midfoot region 12 generally includes portions of footwear 10 corresponding with the arch area of the foot, and heel region 13 corresponds with rear portions of the foot, including the calcaneus bone. Lateral side 14 and medial side 15 extend through each of regions 11-13 and correspond with opposite sides of footwear 10. Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be applied to upper 20, sole structure 30, and individual elements thereof.

Upper 20 is depicted as having a substantially conventional configuration incorporating a plurality material elements (e.g., textiles, foam, leather, and synthetic leather) that are stitched or adhesively bonded together to form an interior void for securely and comfortably receiving a foot. The material elements may be selected and located with respect to upper 20 in order to selectively impart properties of durability, air-permeability, wear-resistance, flexibility, and comfort, for example. An ankle opening 21 in heel region 13 provides access to the interior void. In addition, upper 20 may include a lace 22 that is utilized in a conventional manner to modify the dimensions of the interior void, thereby securing the foot within the interior void and facilitating entry and removal of the foot from the interior void. Lace 22 may extend through apertures in upper 20, and a tongue portion of upper 20 may extend between the interior void and lace 22. Given that various aspects of the present discussion primarily relate to sole structure 30 and at least one fluid system within sole structure 30, upper 20 may exhibit the general configuration discussed above or the general configuration of practically any other conventional or non-conventional upper. Accordingly, the structure of upper 20 may vary significantly within the scope of the present invention.

Sole structure 30 is positioned below upper 20 and includes two primary elements, a midsole 31 and an outsole 32. Midsole 31 is secured to a lower surface of upper 20 (e.g., through stitching or adhesive bonding) and operates to attenuate ground reaction forces as sole structure 30 contacts and is compressed against the ground during walking, running, or other ambulatory activities. Midsole 31 is primarily formed of a polymer foam material, such as polyurethane or ethylvinylacetate, that at least partially encapsulates a fluid system 40, which is discussed in greater detail below. Outsole 32 is secured to a lower surface of midsole 31 and is formed of a durable and wear-resistant rubber material that engages the ground. In addition, sole structure 30 may include an insole 33, which is located within the void in upper 20 and adjacent to the foot to enhance the comfort of footwear 10.

Fluid system 40 is depicted individually in FIGS. 3-6 and provides a structure that utilizes ambient air to impart additional force attenuation as sole structure 30 contacts and is compressed against the ground. In addition, fluid system 40 may impart stability to footwear 10, improve the responsiveness of sole structure 30, and enhance the ride characteristics of sole structure 30. The primary elements of fluid system 40 are an inlet 41, a pump chamber 42, a conduit 43, a valve 44, and a pressure chamber 45. In operation, a fluid (i.e., air from the exterior of fluid system 40 or footwear 10) is drawn through inlet 41 and into pump chamber 42. As pump chamber 42 is compressed by a downward force from the foot, the fluid enters conduit 43 and passes through valve 44 to enter pressure chamber 45. Valve 44 may be one-directional to prevent the fluid from exiting pressure chamber 45 through conduit 43. A combination of the polymer foam material of midsole 31, the fluid within pump chamber 42, and the fluid within pressure chamber 45 imparts the ground reaction force attenuation that is provided by sole structure 30. In some configurations of footwear 10, however, a majority of the ground reaction force attenuation may be imparted by pressure chamber 45.

Inlet 41 permits ambient air to enter pump chamber 42 and is illustrated as an opening in an upper surface of pump chamber 42. As depicted in FIG. 2, the upper surface of pump chamber 42 coincides with an upper surface of midsole 31 and is adjacent to a lower portion of upper 20. In this configuration, air may be drawn into inlet 41 through portions of upper 20 and insole 33. As the foot compresses pump chamber 42, however, inlet 41 may be effectively sealed by downward pressure from the foot to prevent air from passing through inlet 41 in a reverse direction (i.e., out of pump chamber 42). In other configurations, inlet 41 may include a valve that prevents air from exiting fluid system 40. More particularly, inlet 41 may include a conduit with a one-directional valve and a filter assembly, as disclosed in U.S. Pat. No. 6,889,451 to Passke and U.S. Pat. No. 7,051,456 to Swigart, et al., both of which are incorporated herein by reference.

Figure 3:
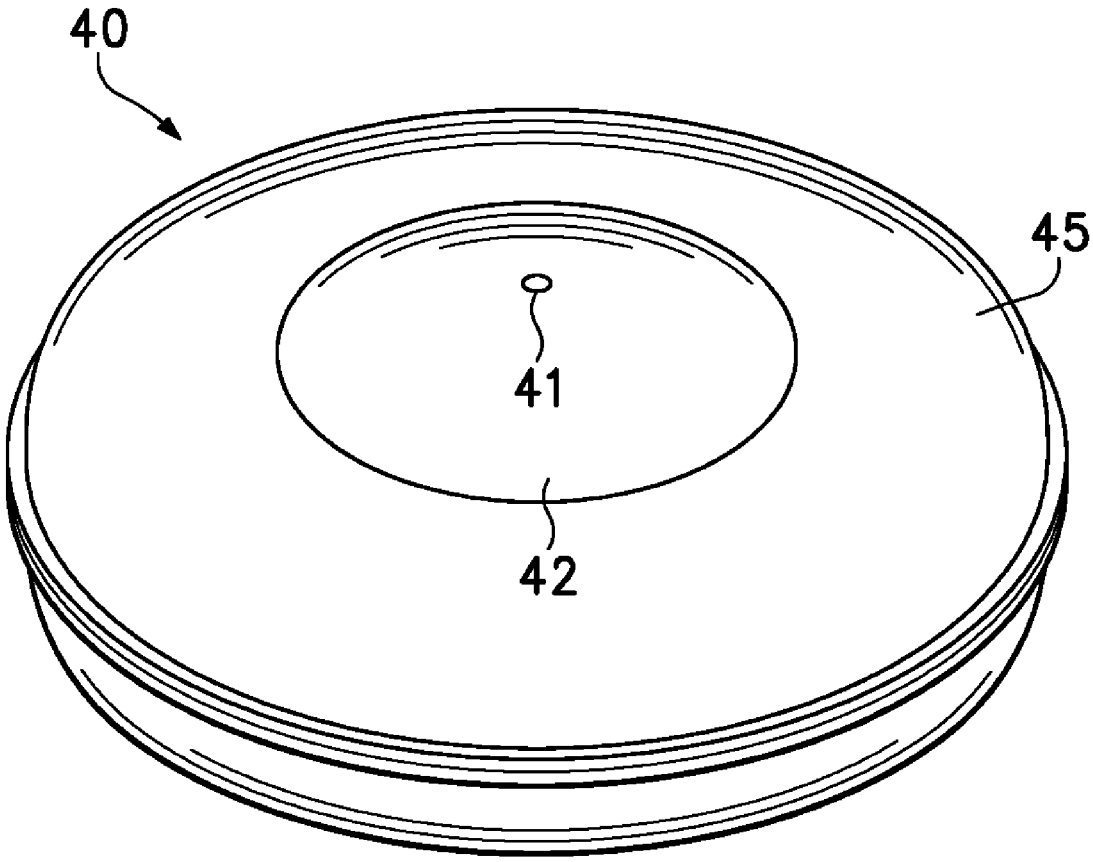
FIG. 3 is a perspective view of the first fluid system.
Figure 4:
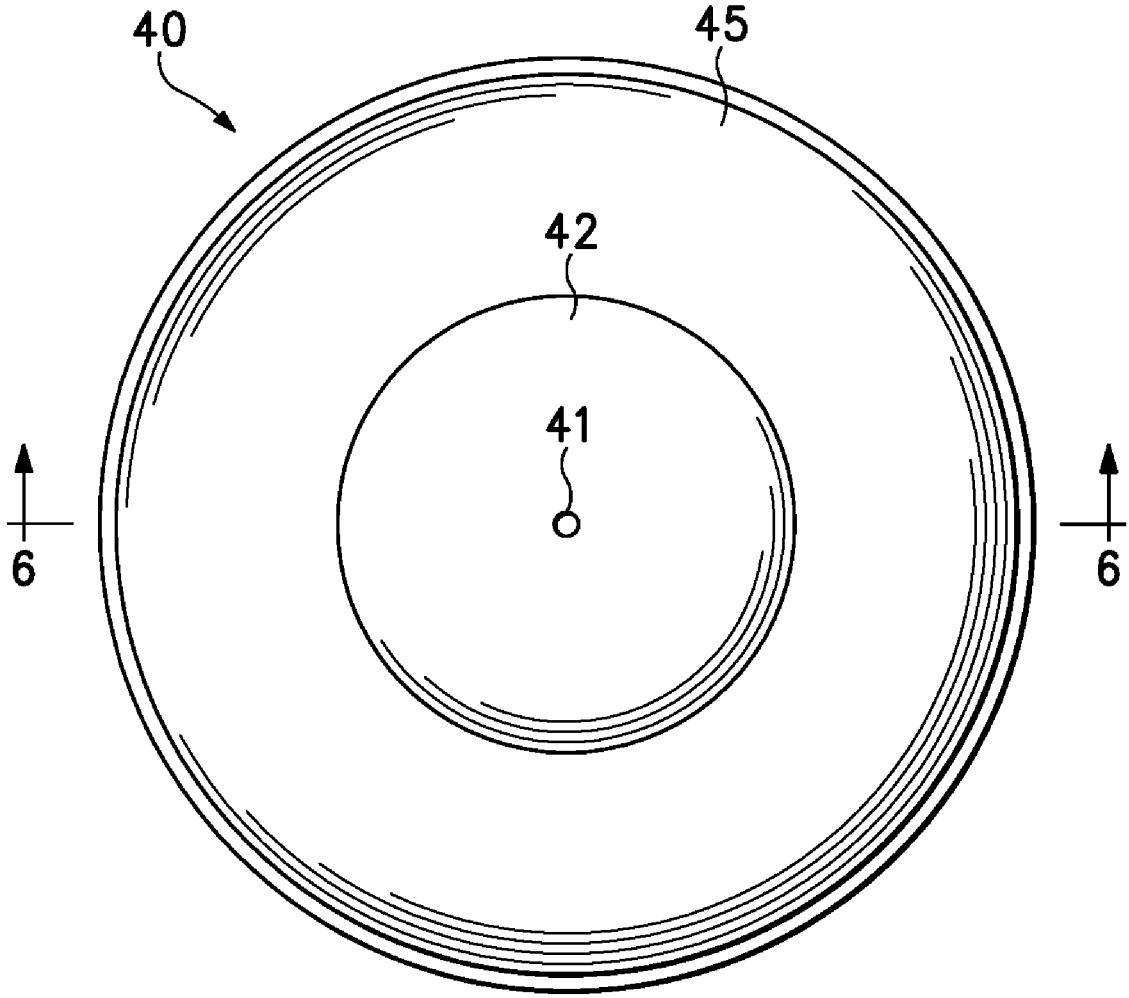
FIG. 4 is a top plan view of the first fluid system.
Figure 5:
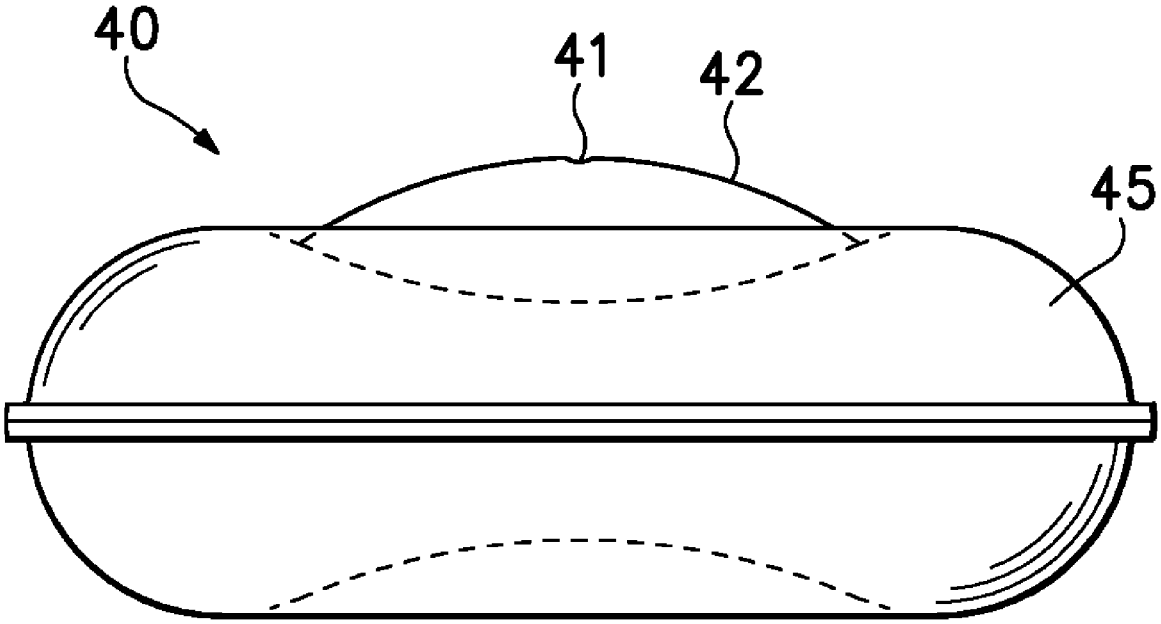
FIG. 5 is a side elevational view of the first fluid system.

Pump chamber 42 is located adjacent to pressure chamber 45 and above pressure chamber 45. Referring to FIGS. 3 and 4, pump chamber 42 has a generally circular shape and is recessed into an upper surface of pressure chamber 45. As depicted in the cross-section of FIG. 6, pump chamber 42 is formed from two layers **46*a* and 46*b* that are bonded or otherwise joined about their peripheries. Whereas the peripheries of layers 46*a* and 46*b* are joined, a central area of layers 46*a* and 46*b* remains unbonded to form an interior void within pump chamber 42 and between layers 46*a* and 46*b*. In this configuration, the central area of pump chamber 42 exhibits greater thickness than the periphery of pump chamber 42. Although this configuration for pump chamber 42 provides a suitable structure for fluid system 40, pump chamber 42 may be formed to have a non-circular shape (e.g., elliptical, triangular, square, non-regular) or a configuration wherein the periphery has greater or equal thickness when compared to the central area. Additionally, pump chamber 42 may be positioned below pressure chamber 45 or in a non-recessed relationship with pressure chamber 45 in some configurations of fluid system 40. Although pump chamber 42 is depicted as being centered relative to pressure chamber 45, pump chamber 42 may be offset or otherwise non-centrally located relative to pressure chamber 45, and the relative dimensions and volumes of pump chamber 42 and pressure chamber 45 may vary. Accordingly, the specific configuration and orientation of pump chamber 42 and pressure chamber 45** may vary significantly.

Figure 6:
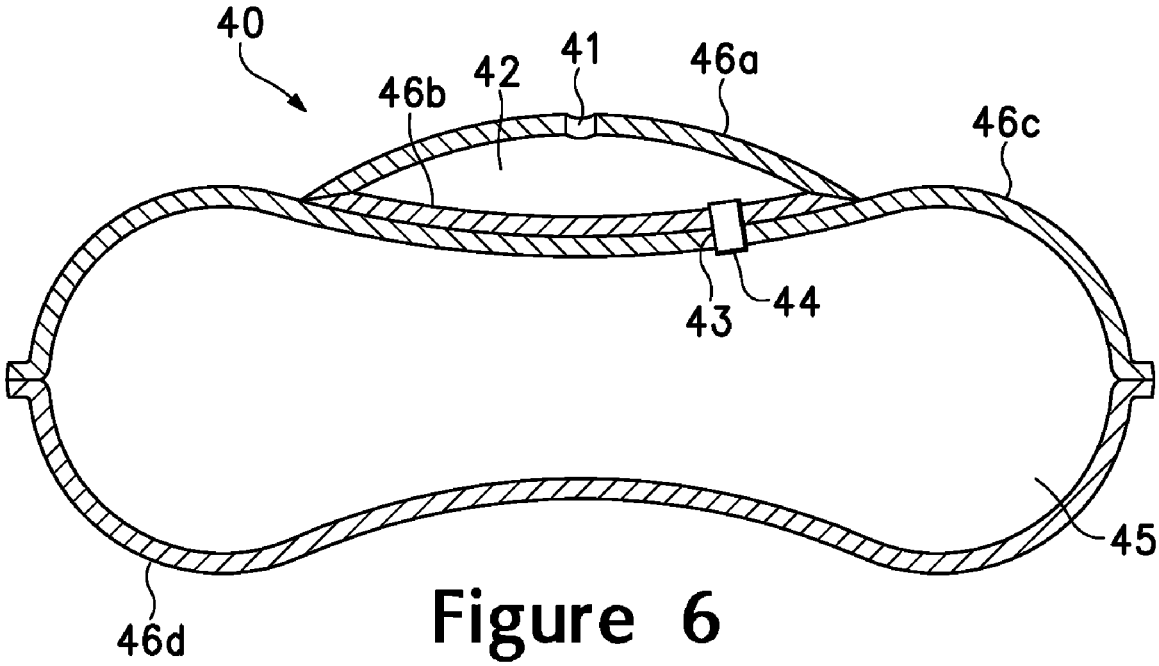
FIG. 6 is a cross-sectional view of the first fluid system, as defined by section line 6-6 in FIG. 4.

Conduit 43 provides a fluid path between chambers 42 and 45. That is, fluid passing from pump chamber 42 to pressure chamber 45 generally passes through conduit 43. As depicted in FIG. 6, conduit 43 is an opening in the materials forming chambers 42 and 45, and the fluid passes through the opening. Valve 44 is positioned within conduit 43 in order to regulate the direction of fluid flow through conduit 43. In general, valve 44 is a one-directional valve that permits fluid flow from pump chamber 42 to pressure chamber 45, but substantially limits fluid flow from pressure chamber 45 to pump chamber 42. Examples of suitable one-directional valves include the polymer layer valves disclosed in U.S. Pat. No. 6,936,130 to Dojan, et al. and duckbill valves manufactured by Vernay Laboratories, Inc. Depending upon the desired characteristics and operation of fluid system 40, two-directional valves that also permit fluid flow from pressure chamber 45 to pump chamber 42 may also be utilized in fluid system 40. In some configurations valve 44 or another valve may allow the fluid to exit pressure chamber 45 in order to prevent the fluid from exceeding a predetermined fluid pressure. Valve 44 may also be selected to restrict the flow rate of the fluid being transferred from pump chamber 42 to pressure chamber 45. Accordingly, valves within fluid system 40 may be utilized to affect or otherwise control the performance characteristics of fluid system 40.

Pressure chamber 45 is located adjacent to pump chamber 42 and below pump chamber 42. Referring to FIGS. 3 and 4, pressure chamber 45 has a generally circular shape with a larger diameter than pump chamber 42, and the upper surface of pressure chamber 45 forms a depression that receives pump chamber 42, thereby recessing pump chamber 42 into the upper surface of pressure chamber 45. As depicted in the cross-section of FIG. 6, pressure chamber 45 is formed from two layers 46*c* and 46*d* that are bonded or otherwise joined about their peripheries. Whereas the peripheries of layers 46*c* and 46*d* are joined, a central area of layers 46*c* and 46*d* remains unbonded to form an interior void within pressure chamber 45 and between layers 46*c* and 46*d*. Due to the depression in the upper surface of pressure chamber 45, and a corresponding depression in a lower surface of pressure chamber 45, the central area of pressure chamber 45 exhibits lesser thickness than the periphery of pressure chamber 45. Although this configuration for pressure chamber 45 provides a suitable structure for fluid system 40, pressure chamber 45 may be formed to have a non-circular shape or a configuration that does not define depressions in the upper and lower surfaces, for example. As with pump chamber 42, therefore, the specific configuration of pressure chamber 45 may vary significantly.

Although pump chamber 42 is positioned within the depression in the upper surface of pressure chamber 45, at least one-half of a volume of pump chamber 42 is located above a highest point of the upper surface of pressure chamber 45. In this configuration, downward forces from the foot may continue to compress pump chamber 42 as the fluid pressure within pressure chamber 45 increases. That is, locating a significant portion of pump chamber 42 above the highest point of pressure chamber 45 ensures that pump chamber 42 may be compressed by the foot as the pressure within pressure chamber 45 increases. In other configurations, pump chamber 42 may be recessed further into pressure chamber 45 to impart a self-limiting aspect to fluid system 40. That is, as the degree to which pump chamber 42 is recessed into pressure chamber 45 increases, the resulting pressure within pressure chamber 45 may be limited. Accordingly, the relative positions of chambers 42 and 45 may be modified to alter the pressure characteristics of fluid system 40.

As discussed in greater detail below, layers 46*a*-46*d* are polymer materials (e.g., thermoplastic polymer materials) that are bonded or otherwise joined about their peripheries to form chambers 42 and 45. In order to impart shape to chambers 42 and 45, layers 46*a*-46*d* may be heated or otherwise thermoformed during the manufacturing processes of chambers 42 and 45. Prior to shaping chambers 42 and 45, inlet 41 may be formed as an aperture extending through layer 46*a*, conduit 43 may be formed as an aperture extending through both of layers 46*b* and 46*c*, and valve 44 may be positioned between layers 46*b* and 46*c*. As an alternative to being formed from layers 46*a*-46*d*, chambers 42 and 45 may be formed through blow-molding or rotational-molding processes, for example.

Figure 7A:
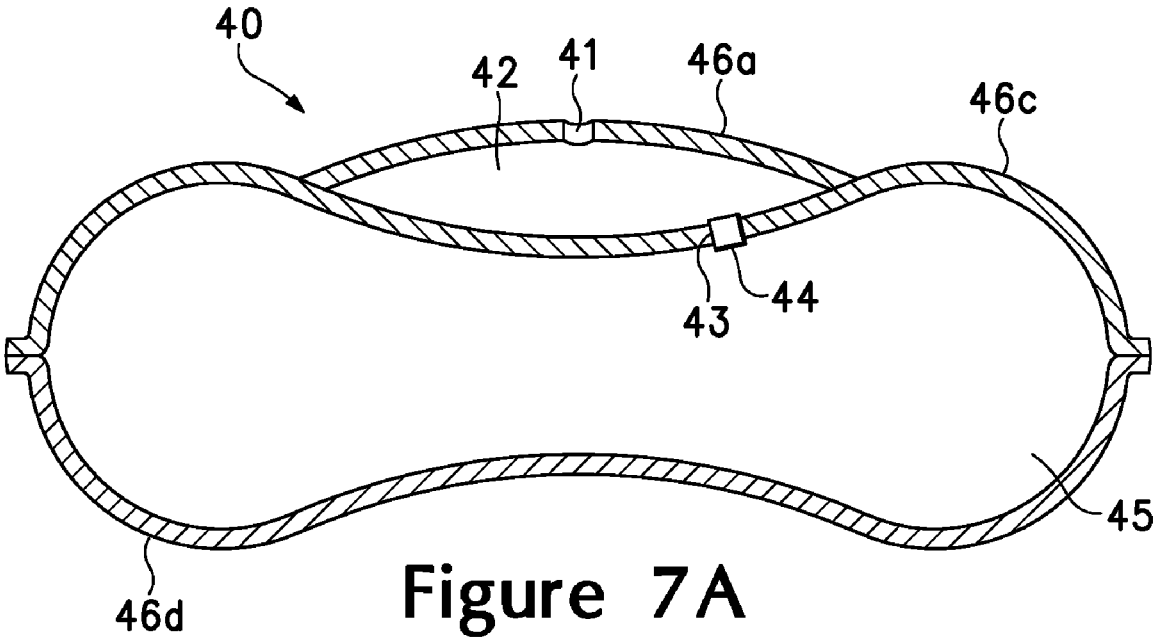
FIGS. 7A-7D are cross-sectional views corresponding with FIG. 6 and depicting alternate configurations of the first fluid system.

When formed from layers 46*a*-46*d*, chambers 42 and 45 may be formed separately and subsequently located adjacent to each other within sole structure 30. That is, pump chamber 42 may be formed from layers 46*a* and 46*b*, and pressure chamber 45 may be formed separately from layers 46*c* and 46*d*. In this configuration, two layers of polymer material (i.e., layers 46*b* and 46*c*) separate the fluid within pump chamber 42 from the fluid within pump chamber 45. As an alternative to this configuration, layer 46*b* may be eliminated such that chambers 42 and 45 are formed as a single structure. Referring to the cross-section of FIG. 7A, chambers 42 and 45 are formed from layers 46*a*, 46*c*, and 46*d*, with layer 46*c* forming a single, common layer of polymer material that is bonded to each of layers 46*a* and 46*d* and separates the fluid within pump chamber 42 from the fluid within pump chamber 45. Accordingly, the fluid within pump chamber 42 may be separated from the fluid within pressure chamber 45 by a single layer of polymer material (i.e., layer 46*c*). In some configurations, one or both of chambers 42 and 45 may be formed from more than two layers to impart an expandable configuration, as disclosed in U.S. patent application Ser. No. 11/255,091, which was filed in the U.S. Patent and Trademark Office on Oct. 19, 2006 and entitled Fluid System Having An Expandable Pump Chamber, such prior U.S. patent application being entirely incorporated herein by reference.

Figure 7B:
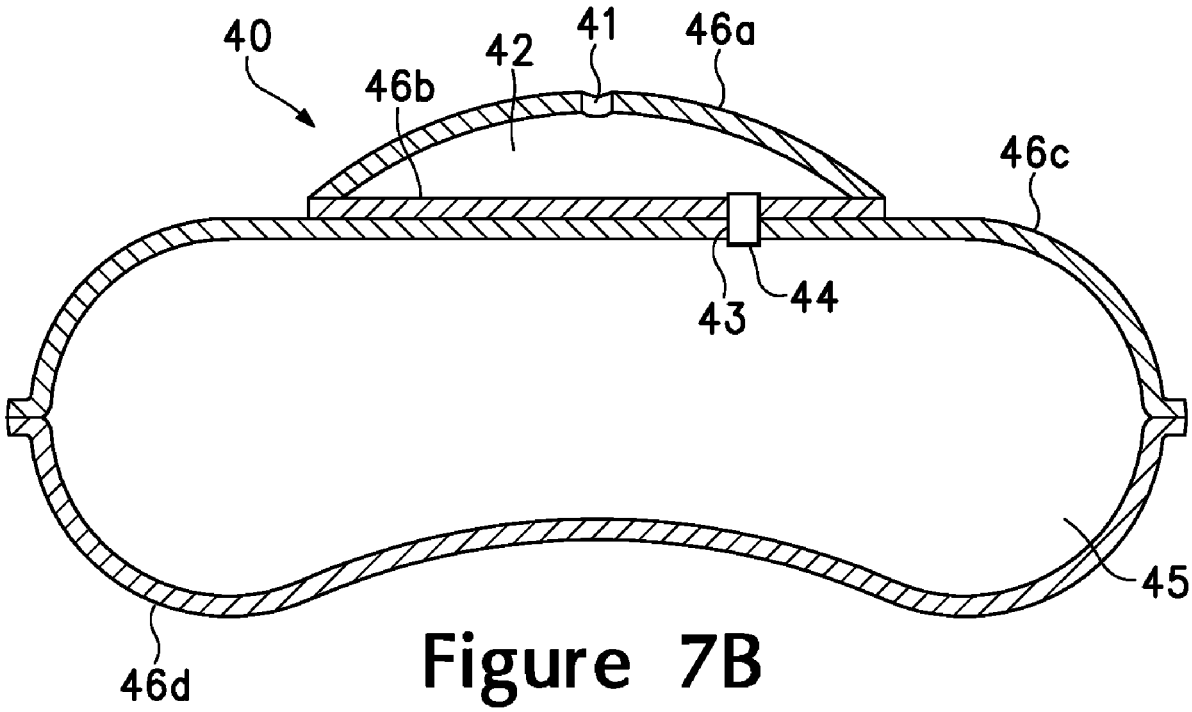
Figure 7C:
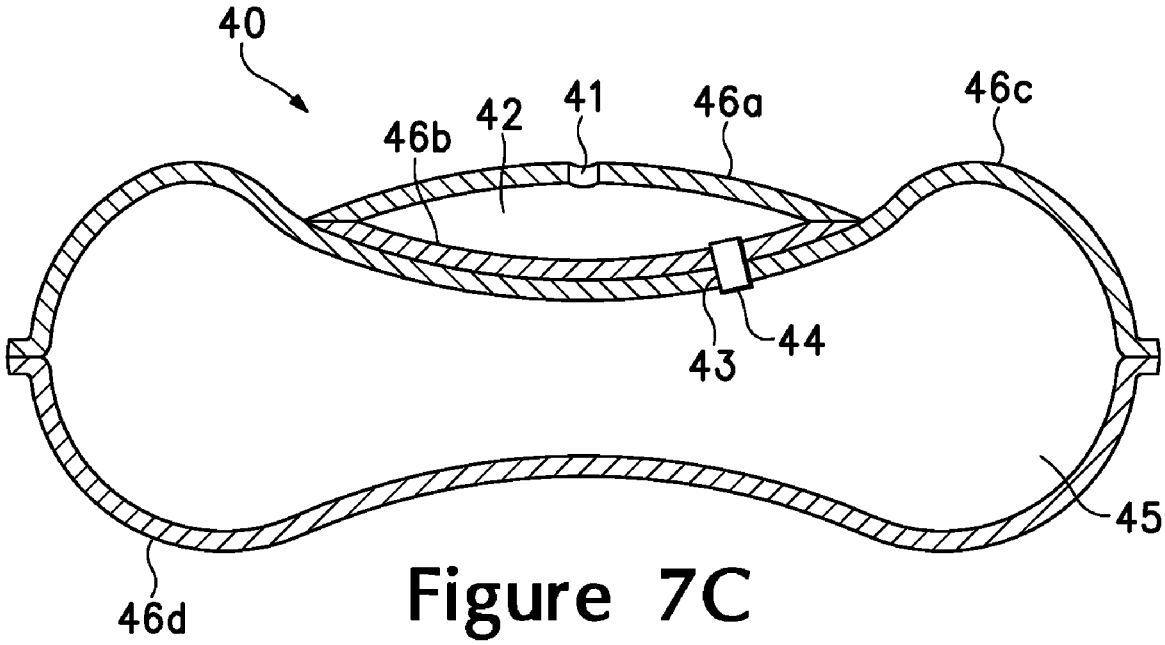

As discussed above, locating a significant portion of pump chamber 42 above the highest point of pressure chamber 45 ensures that pump chamber 42 may be compressed by the foot as the pressure within pressure chamber 45 increases. Although a configuration wherein at least one-half of the volume of pump chamber 42 is located above the highest point of pressure chamber 45 generally ensures that pump chamber 42 may be compressed, some configurations of fluid system 40 may benefit when a greater volume of pump chamber 42 is exposed. Referring to FIG. 7B, the upper surface of pressure chamber 45 is depicted as having a generally planar configuration, thereby locating substantially all of pump chamber 42 above the highest point of pressure chamber 45. In other configurations, recessing pump chamber 42 to a greater degree may be beneficial to fluid system 40, particularly when a self-limiting property is beneficial to fluid system 40. Referring to FIG. 7C, the upper surface of pressure chamber 45 is depicted as having a greater depression than in FIG. 6, thereby locating substantially all of pump chamber 42 within the depression of pressure chamber 45. Accordingly, the degree to which pump chamber 42 is recessed within a depression in pressure chamber 45 may vary significantly.

Figure 7D:
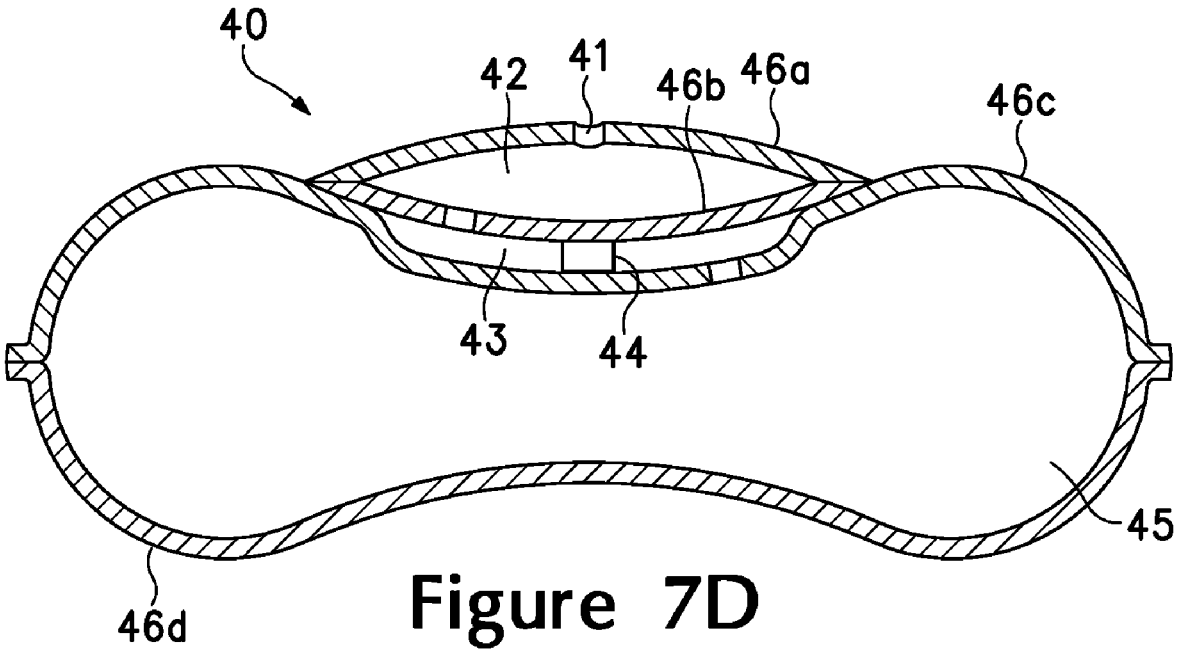

When conduit 43 is formed as apertures that extend through layers 46*b* and 46*c*, portions of valve 44 may extend or otherwise protrude into pressure chamber 45, as depicted in FIG. 6. An advantage to this configuration is that substantially all of the fluid path extending between chambers 42 and 45 is located between chambers 42 and 45. That is, conduit 43 is located entirely within fluid system 40. As depicted in FIG. 7D, however, conduit 43 may be formed as a passage that extends between and parallel to layers 46*b* and 46*c*. Depending upon the configuration of valve 44, for example, forming conduit 43 as a passage between layers 46*b* and 46*c* may provide a more suitable manner of incorporating valve 44 into fluid system 40.

Figure 8A:
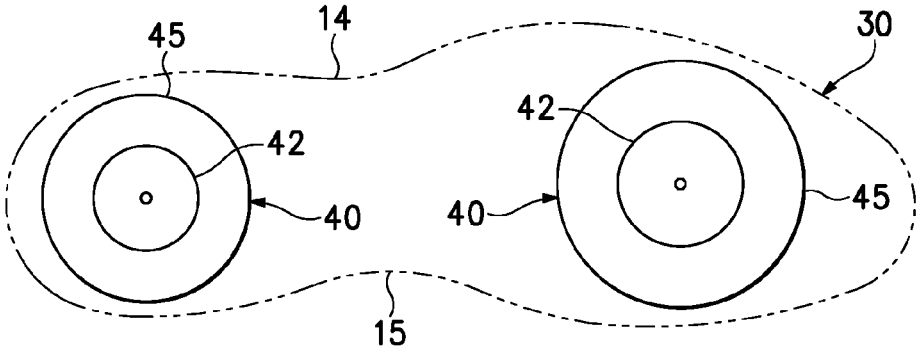
FIGS. 8A-8D are schematic top plan views of a sole structure depicting alternate configurations of the article of footwear.
Figure 8B:
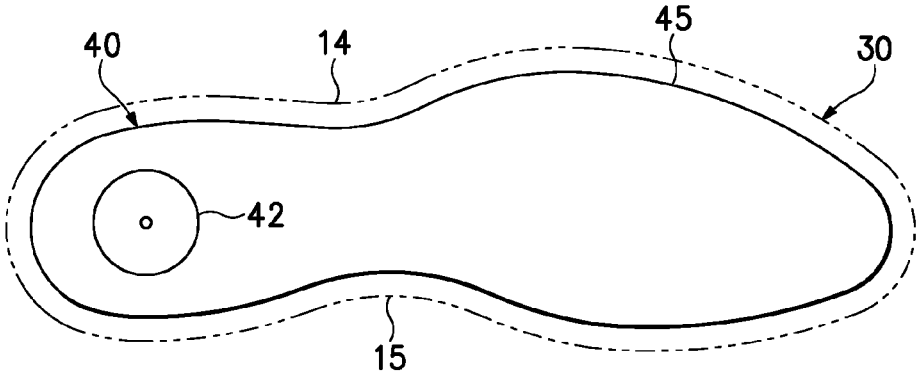

Fluid system 40 is depicted in FIG. 2 as being located within heel region 13. In general, the portion of the foot experiencing the greatest ground reaction forces during walking, running, or other ambulatory activities is the heel. Accordingly, locating fluid system 40 within heel region 13 serves to attenuate forces in the area where the forces may be most prevalent. In further configurations of footwear 10, fluid system 40 or additional fluid systems 40 may be located within other portions of sole structure 30. Referring to FIG. 8A, for example, sole structure 30 is depicted as including a second fluid system 40 in forefoot region 11 to impart additional ground reaction force attenuation. As another example, fluid system 40 may have a configuration that extends through each of regions 11-13, as depicted in FIG. 8B. More particularly, pressure chamber 45 extends from forefoot region 11 to heel region 13, but pump chamber 42 remains limited to heel region 13. In other configurations, pump chamber 42 may be located in another region of sole structure 30 or may also extend from forefoot region 11 to heel region 13.

An advantage to fluid system 40 relates to the relative locations of pump chamber 42 and pressure chamber 45. As discussed above, pump chamber 42 is located above pressure chamber 45. That is, chambers 42 and 45 are vertically-aligned within sole structure 30. Initially (i.e., when the individual first places footwear 10 upon a foot), the fluid pressure within each of chambers 42 and 45 may be substantially equal to the fluid pressure on the exterior of footwear 10. During the operation of fluid system 40 (i.e., as the individual takes successive steps during walking and running), two events occur simultaneously. First, the downward force from the foot compresses pump chamber 42 and induces fluid within pump chamber 42 to enter and pressurize pressure chamber 45. Second, the pressurized fluid within pressure chamber 45 attenuates the equal and opposite force (i.e., the ground reaction force) upon the foot. In effect, therefore, the same force that serves to operate fluid system 40 is also attenuated by fluid system 40. If, for example, pump chamber 42 was separate from pressure chamber 45, then a force from one portion of the foot would operate fluid system 40 and a force from another portion of the foot would be attenuated by fluid system 40. Accordingly, by vertically-aligning chambers 42 and 45, forces that operate fluid system 40 are also attenuated by fluid system 40. Eventually, fluid system 40 reaches an equilibrium state wherein the downward force from the foot compresses pump chamber 42, but does not induce fluid within pump chamber 42 to enter pressure chamber 45.

Figure 8C:
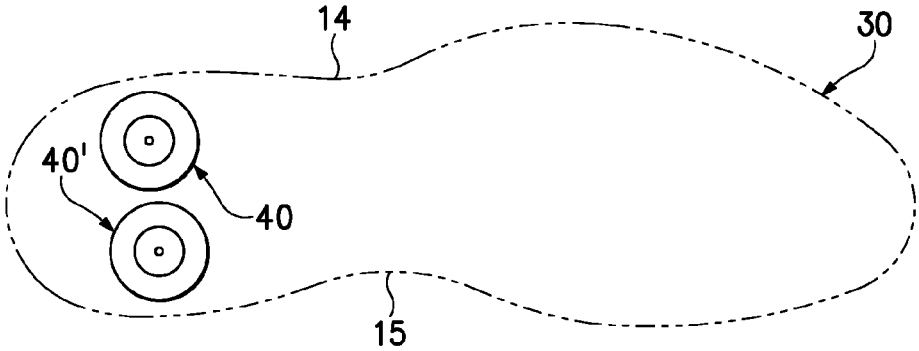

Referring to FIG. 8C, sole structure 30 is depicted as incorporating a fluid system 40 and another substantially identical fluid system 40', both of which are located in heel region 13. Whereas fluid system 40 is positioned adjacent to lateral side 14, fluid system 40' is positioned adjacent to medial side 15. For most individuals, a rear-lateral portion of the foot contacts the ground first during running. As the foot rolls forward, the foot also rotates to the medial side, a process that is referred to as pronation. In the configuration of FIG. 8C, therefore, fluid system 40 will likely experience forces associated with footstrike, whereas fluid system 40' will likely experience forces that occur at the foot pronates to medial side 15. That is, fluid systems 40 and 40' will experience forces at different times and with different magnitudes. As discussed above, by vertically-aligning chambers 42 and 45, forces that operate fluid system 40 (and fluid system 40') are also attenuated by fluid system 40 (and fluid system 40'). Accordingly, fluid systems 40 and 40' operate independently to attenuate forces that are respectively experienced by lateral side 14 and medial side 15. Given that different individuals may place different degrees of force upon fluid systems 40 and 40', pressure chambers 45 within fluid systems 40 and 40' will inflate to different pressures that are customized by running or walking styles of different individuals.

Figure 8D:
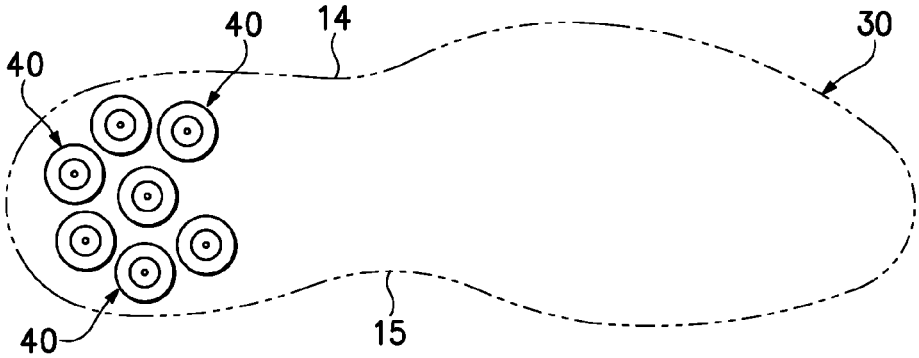
Figure 9:
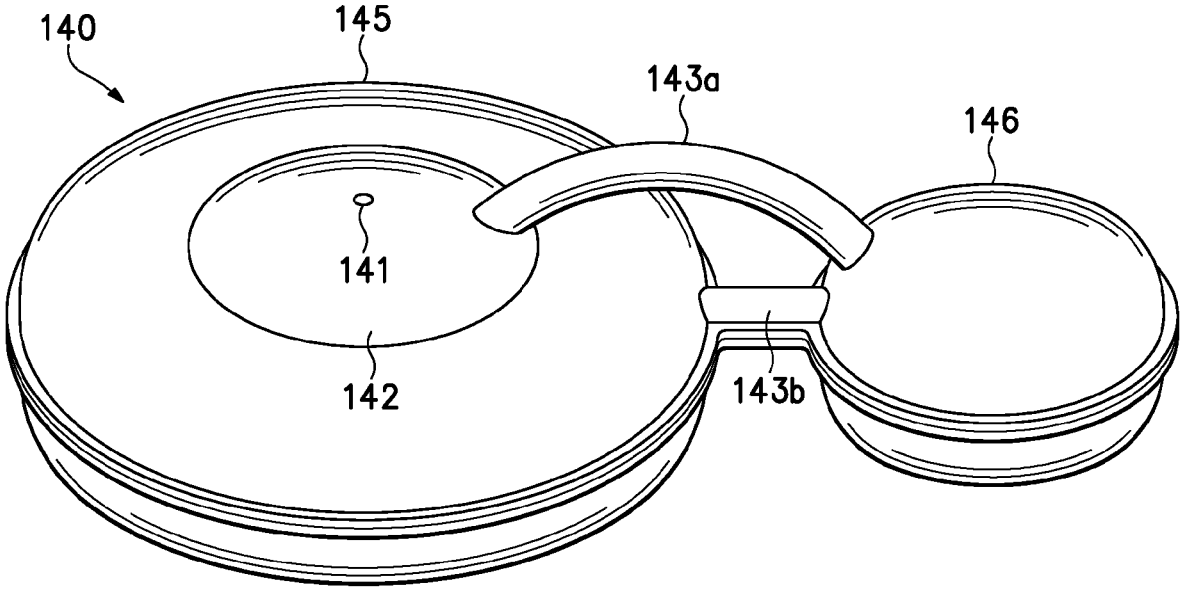
FIG. 9 is a perspective view of a second fluid system.
Figure 10:
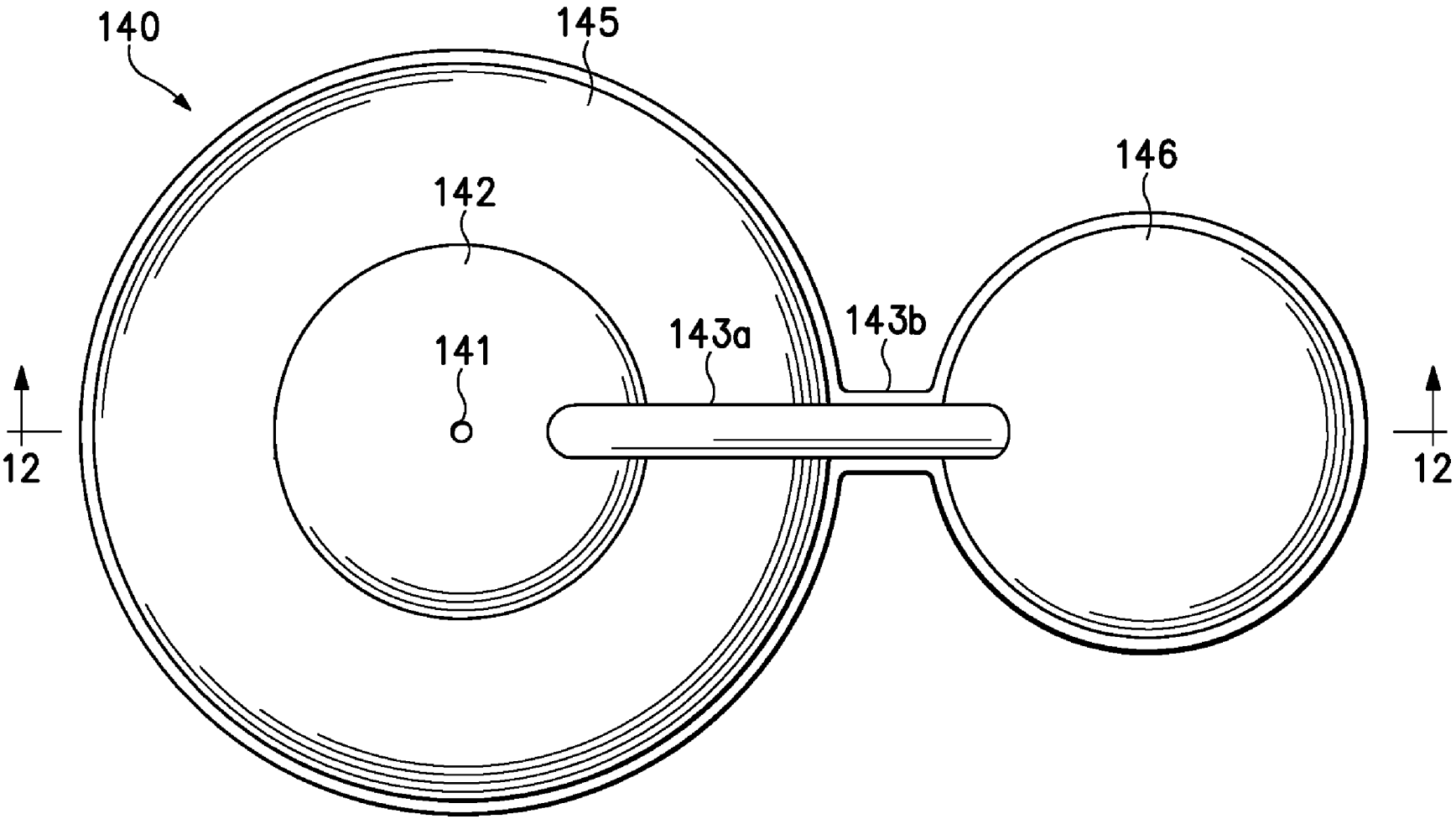
FIG. 10 is a top plan view of the second fluid system.
Figure 11:
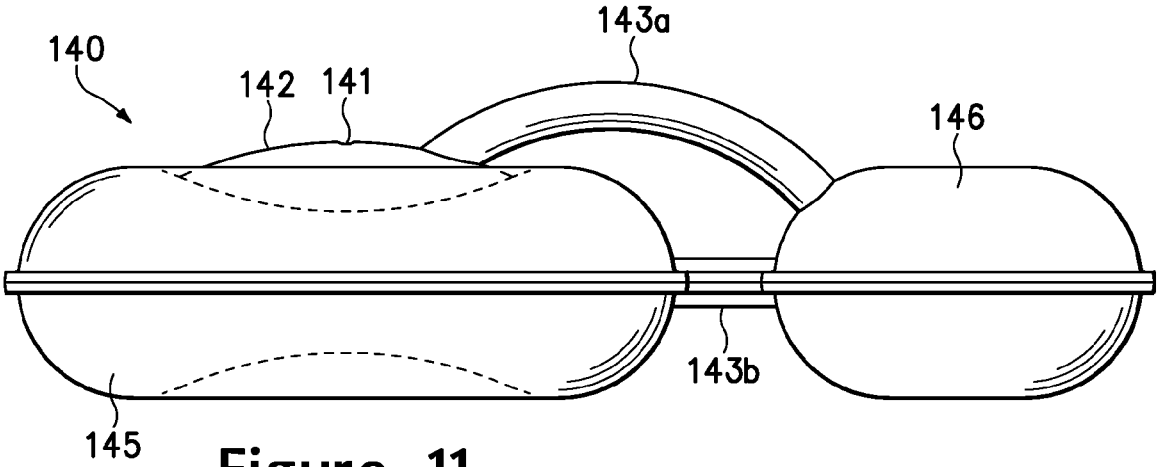
FIG. 11 is a side elevational view of the second fluid system.
Figure 12:
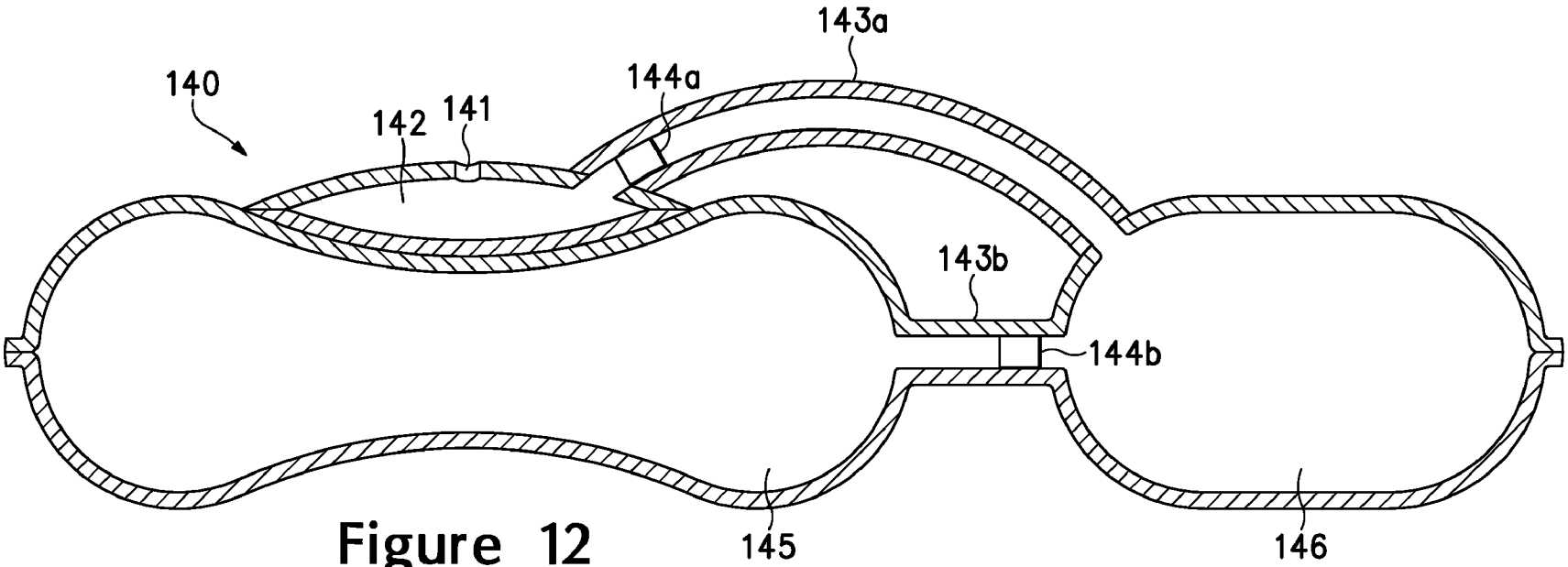
FIG. 12 is a cross-sectional view of the second fluid system, as defined by section line 12-12 in FIG. 10.

The configuration of FIG. 8C demonstrates that separate fluid systems 40 may be incorporated into sole structure 30 in order to attenuate the different forces in different areas of sole structure 30. Referring to FIG. 8D, seven fluid systems 40 are distributed through heel region 13 of sole structure 30. During running or walking, each of fluid systems 40 may experience different forces from the foot, which results in different pressures within the various pressure chambers 45. Accordingly, each of fluid systems 40 will inflate to different pressures depending upon the downward forces generated by the foot in each area of sole structure 30. In further configurations of footwear 10, additional fluid systems 40 may also be located within forefoot region 11 and midfoot region 12.

A variety of materials are suitable for layers 46*a*-46*d* of chambers 42 and 45, including barrier materials that are substantially impermeable to the fluid within fluid system 40. Such barrier materials may include, for example, alternating layers of thermoplastic polyurethane and ethylene-vinyl alcohol copolymer, as disclosed in U.S. Pat. Nos. 5,713,141 and 5,952,065 to Mitchell et al. A variation upon this material wherein the center layer is formed of ethylene-vinyl alcohol copolymer, the two layers adjacent to the center layer are formed of thermoplastic polyurethane, and the outer layers are formed of a regrind material of thermoplastic polyurethane and ethylene-vinyl alcohol copolymer may also be utilized. Another suitable material is a flexible microlayer material that includes alternating layers of a gas barrier material and an elastomeric material, as disclosed in U.S. Pat. Nos. 6,082,025 and 6,127,026 to Bonk et al. Although chambers 42 and 45 may be formed of the barrier materials discussed above, more economical thermoplastic elastomer materials that are at least partially impermeable to the fluid within fluid system 40 may also be utilized. As discussed above, fluid system 40 operates to draw air into chambers 42 and 45 in order to provide ground reaction force attenuation to footwear 10. If a portion of the fluid within pump chamber 42 or pressure chamber 45 should escape from fluid system 40 by diffusion, for example, then fluid system 40 will operate to draw additional fluid into chambers 42 and 45, thereby replenishing the escaped fluid. Accordingly, the material forming chambers 42 and 45 need not provide a barrier that is substantially impermeable to the fluid within fluid system 40, but may be at least partially impermeable to the fluid within fluid system 40. Suitable polymer materials include, therefore, thermoplastic elastomers such as polyurethane, polyester, polyester polyurethane, and polyether polyurethane. In addition to decreased manufacturing costs, a benefit of utilizing these thermoplastic elastomers is that the specific material forming chambers 42 and 45 may be selected based primarily upon the engineering properties of the material, rather than the barrier properties of the material. Accordingly, the material forming chambers 42 and 45 may be selected to exhibit a specific tensile strength, flexibility, durability, degree of light transmission, color, elasticity, resistance to corrosion or chemical breakdown, or abrasion resistance, for example.

Second Fluid System

As an alternative to fluid system 40, footwear 10 may also incorporate a fluid system 140, which is depicted individually in FIGS. 9-12. Fluid system 140 provides a structure that utilizes ambient air to impart additional force attenuation as sole structure 30 contacts and is compressed against the ground. In addition, fluid system 140 may impart stability to footwear 10, improve the responsiveness of sole structure 30, and enhance the ride characteristics of sole structure 30. The primary elements of fluid system 140 are an inlet 141, a pump chamber 142, a pair of conduits 143*a* and 143*b*, a pair of valves 144*a* and 144*b*, a pressure chamber 145, and a collecting chamber 146. In operation, a fluid (i.e., air from the exterior of fluid system 140 or footwear 10) is drawn through inlet 141 and into pump chamber 142. As pump chamber 142 is compressed by a downward force from the foot, the fluid enters conduit 143*a* and passes through valve 144*a* to enter collecting chamber 146. When the pressure of the fluid within collecting chamber 146 exceeds the pressure of the fluid within pressure chamber 145, the fluid within collecting chamber 146 enters conduit 143*b* and passes through valve 144*b* to enter pressure chamber 145. In some configurations, downward forces from the foot may be utilized to compress collecting chamber 146 and further pressurize the fluid within collecting chamber 146, thereby increasing the overall fluid pressure within pressure chamber 145. In contrast with fluid system 40, fluid system 140 incorporates collecting chamber 146 into the fluid path between chambers 142 and 145. A combination of the polymer foam material of midsole 31, the fluid within pump chamber 142, the fluid within collecting chamber 146, and the fluid within pressure chamber 145 imparts the ground reaction force attenuation that is provided by sole structure 30. In some configurations of footwear 10, however, a majority of the ground reaction force attenuation may be imparted by pressure chamber 145.

Based upon the above discussion, fluid system 140 is structurally-similar to fluid system 40 and many of the considerations discussed above for fluid system 40 apply equally to fluid system 140. As with fluid system 40, therefore, pump chamber 142 is located adjacent to pressure chamber 145 and above pressure chamber 145 to impart the advantages discussed above. Although pump chamber 142 is positioned within a depression in an upper surface of pressure chamber 145, at least one-half of a volume of pump chamber 142 is located above a highest point of the upper surface of pressure chamber 145. In other configurations, however, a greater or lesser volume of pump chamber 142 may be located above pressure chamber 145. Although two layers of polymer material are depicted as separating the fluid within pump chamber 142 from the fluid within pump chamber 145, a single layer of polymer material may separate the fluid within pump chamber 142 from the fluid within pump chamber 145 in some configurations of fluid system 140.

Figure 13A:
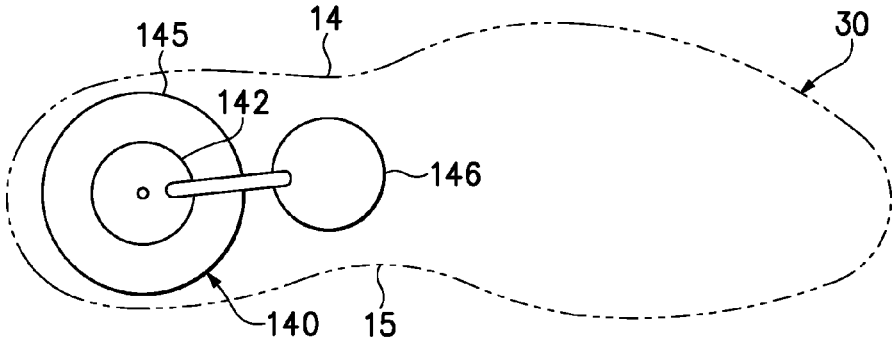
FIGS. 13A-13D are schematic top plan views depicting various configurations of the second fluid system within the sole structure.
Figure 13B:
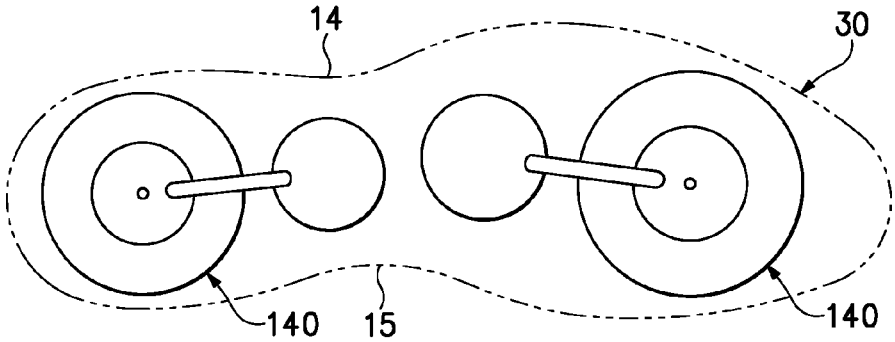
Figure 13C:
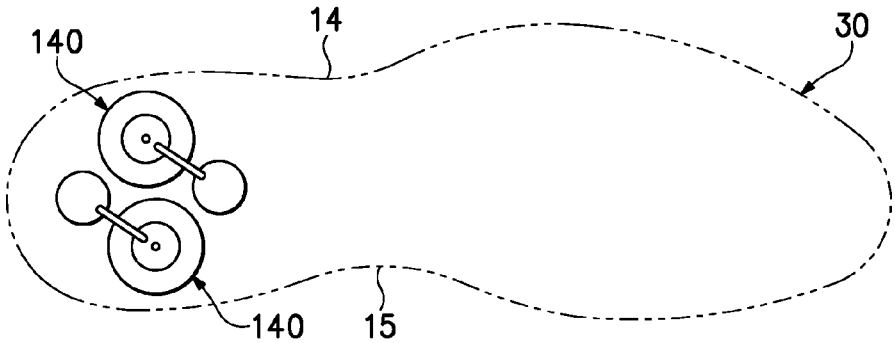
Figure 13D:
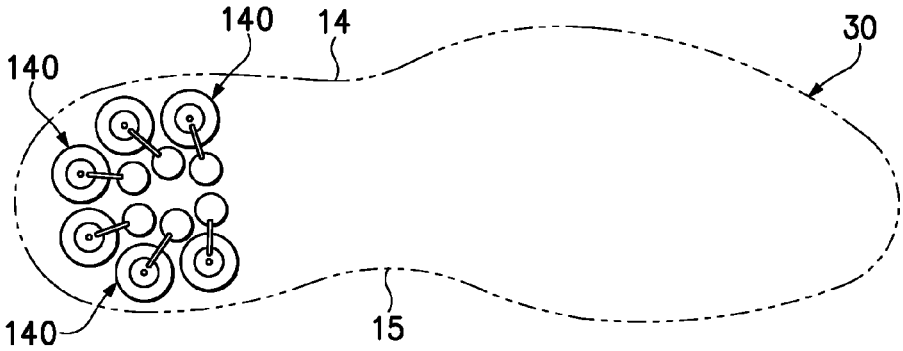

When incorporated into sole structure 30, a single fluid system 140 may be utilized such that chambers 142 and 145 are located within heel region 13 and collecting chamber 146 is located in midfoot region 12, as depicted in FIG. 13A. As an alternative, two fluid systems 140 may be located within sole structure 30, with one being located in heel region 13 and another being located in forefoot region 11. Referring to FIG. 13C, two fluid systems 140 are located in heel region 13 and adjacent to opposite sides 14 and 15. As yet another example of the manner in which fluid system 140 may be incorporated into sole structure 30, FIG. 13D depicts multiple fluid systems 140 located within heel region 13 such that chambers 142 and 145 are positioned around the periphery and collecting chambers 146 are centrally-located. Accordingly, the manner in which fluid system 140 may be incorporated into footwear 10 may vary significantly.

Third Fluid System

Figure 14:
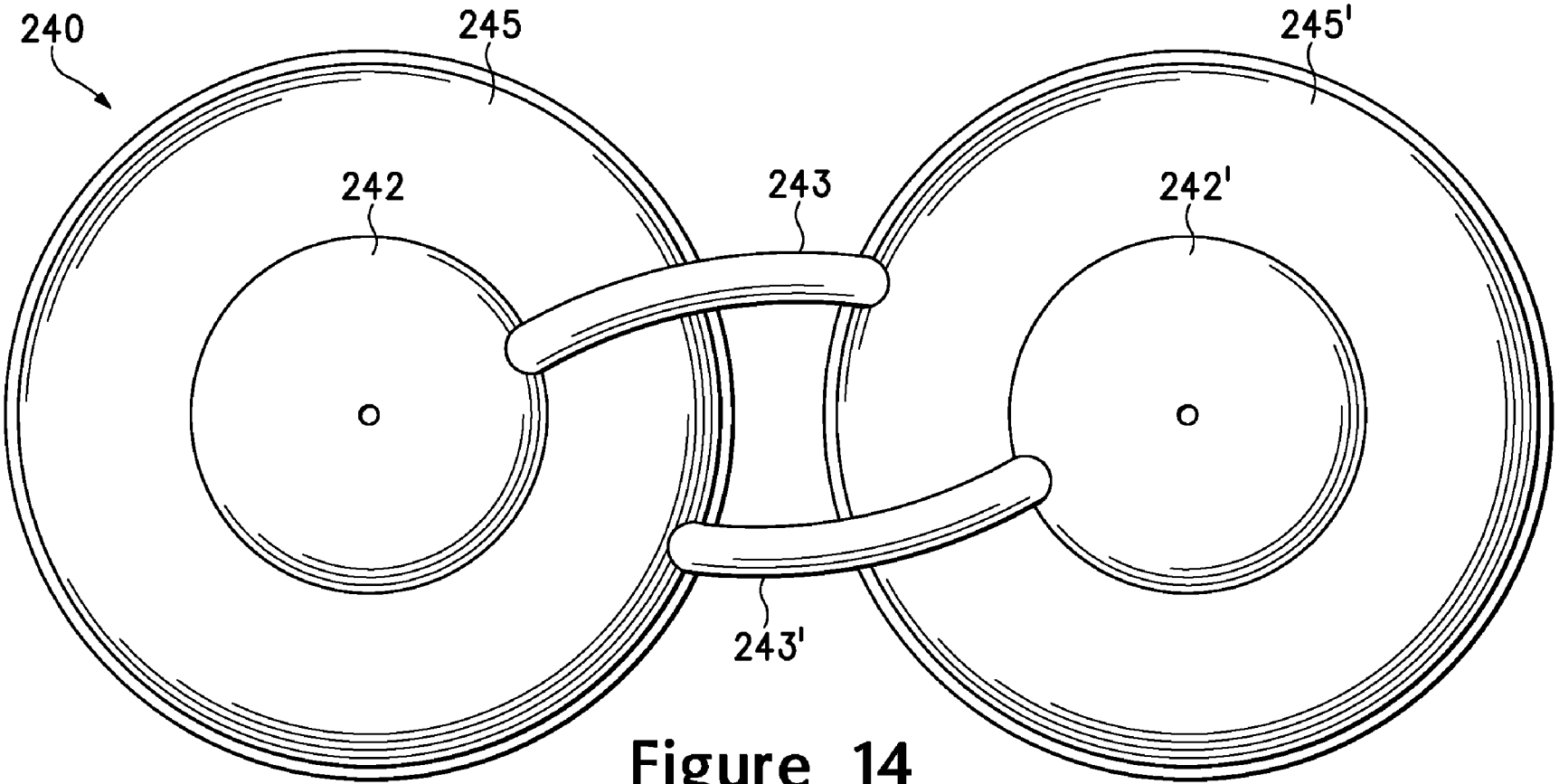
FIG. 14 is a top plan view of a third fluid system.

With reference to FIG. 14, a fluid system 240 is depicted as including two fluid systems that are similar to fluid system 40. More particularly, fluid system 240 includes a first pump chamber 242, a first conduit 243, a first pressure chamber 245, a second pump chamber 242', a second conduit 243', and a second pressure chamber 245'. First pump chamber 242 is located above and adjacent to first pressure chamber 245. Similarly, second pump chamber 242' is located above and adjacent to second pressure chamber 245'. Whereas first conduit 243 extends from first pump chamber 242 to second pressure chamber 245', second conduit 243' extends from second pump chamber 242' to first pressure chamber 245. As with fluid system 40, first pump chamber 242 and first pressure chamber 245 may be separated by a single layer of polymer material, and more than half of first pump chamber 242 may extend above a highest point of first pressure chamber 245.

In operation, a fluid (i.e., air from the exterior of fluid system 240) is drawn through inlets and into each of first pump chamber 242 and second pump chamber 242'. As first pump chamber 242 is compressed by a downward force from the foot, the fluid enters first conduit 243 and passes through a valve to enter second pressure chamber 245'. Similarly, as second pump chamber 242' is compressed by a downward force from the foot, the fluid enters second conduit 243' and passes through a valve to enter first pressure chamber 245. In effect, therefore, two of fluid system 40 are cross-linked such that compression of one pump chamber pressurizes a separate pressure chamber.

The invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

That which is claimed is:

1. An article of footwear having an upper and a sole structure secured to the upper, the sole structure comprising a fluid system with a pump chamber and a pressure chamber located adjacent to and below the pump chamber, the pump chamber and the pressure chamber being vertically aligned, both a portion of the pump chamber and a portion of the pressure chamber being formed from a single, common layer of polymer material, and the fluid system including a fluid path extending between the pump chamber and the pressure chamber, a one-directional valve being located in the fluid path to permit fluid flow from the pump chamber to the pressure chamber and substantially limit fluid flow from the pressure chamber to the pump chamber.

2. The article of footwear recited in claim 1, wherein the fluid system is in fluid communication with ambient air.

3. The article of footwear recited in claim 1, wherein the fluid system is at least partially encapsulated by a polymer foam material of the sole structure.

4. The article of footwear recited in claim 1, wherein the fluid system includes a collecting chamber located in the fluid path.

5. The article of footwear recited in claim 1, wherein the sole structure includes a plurality of the fluid system.

6. An article of footwear having an upper and a sole structure secured to the upper, the sole structure comprising a fluid system with a pump chamber and a pressure chamber located adjacent to and below the pump chamber, the pump chamber and the pressure chamber being vertically aligned, the fluid system including a fluid path extending between the pump chamber and the pressure chamber, substantially all of the fluid path being surrounded by the pump chamber and the pressure chamber, and a one-directional valve being located in the fluid path to permit fluid flow from the pump chamber to the pressure chamber and substantially limit fluid flow from the pressure chamber to the pump chamber.

7. The article of footwear recited in claim 6, wherein the fluid system is in fluid communication with ambient air.

8. The article of footwear recited in claim 6, wherein the fluid system is at least partially encapsulated by a polymer foam material of the sole structure.

9. The article of footwear recited in claim 6, wherein the sole structure includes a plurality of the fluid system.

10. An article of footwear having an upper and a sole structure secured to the upper, substantially all of the sole structure being positioned below the upper, the sole structure comprising at least two separate fluid systems, each of the fluid systems (a) having a pump chamber and a pressure chamber located adjacent to and below the pump chamber, (b) including a fluid path extending between the pump chamber and the pressure chamber, substantially all of the fluid path being surrounded by the pump chamber and the pressure chamber, and (c) including a one-directional valve located in the fluid path.

11. The article of footwear recited in claim 10, wherein one of the fluid systems is located in a lateral portion of the sole structure, and another of the fluid systems is located in a medial portion of the sole structure.

12. The article of footwear recited in claim 10, wherein a single layer of a polymer material separates a fluid within the pump chamber from a fluid within the pressure chamber.

13. The article of footwear recited in claim 10, wherein each of the fluid systems includes a collecting chamber located in the fluid path.

14. The article of footwear recited in claim 13, wherein each of the fluid systems includes a pair of one-directional valves located in the fluid path and on opposite sides of the collecting chamber.

15. The article of footwear recited in claim 13, wherein each of the pump chambers and pressure chambers are located in a peripheral portion of the sole structure, and each the collecting chambers are located in a central portion of the sole structure.

16. An article of footwear having an upper and a sole structure secured to the upper, the sole structure comprising a plurality of fluid systems, each of the fluid systems including:

a pump chamber, substantially all of which is positioned below the upper;

a pressure chamber located adjacent to the pump chamber and below the pump chamber;

a fluid path extending between the pump chamber and the pressure chamber; and a one-directional valve located within the fluid path to permit fluid flow from the pump chamber to the pressure chamber and substantially prevent fluid flow from the pressure chamber to the pump chamber; and wherein the pump chamber and the pressure chamber are within the sole structure.

17. The article of footwear recited in claim 16, wherein a single layer of a polymer material separates a fluid within the pump chamber from a fluid within the pressure chamber.

18. The article of footwear recited in claim 16, wherein each of the fluid systems includes a collecting chamber located in the fluid path.

19. The article of footwear recited in claim 18, wherein the pump chamber and the pressure chamber of each fluid system is located in a peripheral portion of the sole structure, and the collecting chamber of each fluid system is located in a central portion of the sole structure.

20. The article of footwear recited in claim 16, wherein one of the fluid systems is located in a lateral portion of the sole structure, and another of the fluid systems is located in a medial portion of the sole structure.

21. The article of footwear recited in claim 16, wherein the plurality of fluid systems is two of the fluid systems.

22. An article of footwear having an upper defining an interior void and a sole structure secured to the upper and positioned below the void defined by the upper, the sole structure comprising:

a polymer foam material;

a first fluid system at least partially encapsulated within the polymer foam material, the first fluid system including:

a first pump chamber, a first pressure chamber located adjacent to the first pump chamber and below the first pump chamber, a first fluid path extending between the first pump chamber and the first pressure chamber, and a first one-directional valve located within the first fluid path to permit fluid flow from the first pump chamber to the first pressure chamber and substantially prevent fluid flow from the first pressure chamber to the first pump chamber; and a second fluid system at least partially encapsulated within the polymer foam material, the second fluid system including:

a second pump chamber, and a second pressure chamber located adjacent to the second pump chamber and below the second pump chamber, a second fluid path extending between the second pump chamber and the second pressure chamber, and a second one-directional valve located within the second fluid path to permit fluid flow from the second pump chamber to the second pressure chamber and substantially prevent fluid flow from the second pressure chamber to the second pump chamber;

wherein substantially all of the first fluid system and substantially all of the second fluid system is positioned below the void defined by the upper.

23. The article of footwear recited in claim 22, wherein at least a portion of a fluid within the first pump chamber is separated from a fluid within the first pressure chamber by a single layer of a polymer material.

24. The article of footwear recited in claim 22, wherein substantially all of the first fluid path is surrounded by the first pump chamber and the first pressure chamber.

25. The article of footwear recited in claim 22, wherein at least one-half of a volume of the first pump chamber is located above a highest point of an upper surface of the first pressure chamber.

26. The article of footwear recited in claim 22, wherein the first fluid system is located in a lateral portion of the sole structure, and the second fluid system is located in a medial portion of the sole structure.

27. The article of footwear recited in claim 22, wherein the first fluid system includes a collecting chamber located in the first fluid path.

28. The article of footwear recited in claim 27, wherein the first pump chamber and the first pressure chamber are located in a peripheral portion of the sole structure, and the collecting chamber is located in a central portion of the sole structure.

* * * * *